US005158117A

United States Patent [19]

Huhtiniemi

[11] Patent Number: 5,158,117

[45] Date of Patent: Oct. 27, 1992

[54] TWO-LAYER PAPER MACHINE CLOTH

[75] Inventor: Jukka L. Huhtiniemi, Peachtree City, Ga.

[73] Assignee: Tamfelt Oy AB, Tampere, Finland

[21] Appl. No.: 737,873

[22] Filed: Jul. 30, 1991

[51] Int. Cl.[5] ..... D03D 13/00

[52] U.S. Cl. ..... 139/383 A

[58] Field of Search ..... 139/383 A, 413

[56] References Cited

U.S. PATENT DOCUMENTS

| | | | |
|---|---|---|---|
| 3,603,354 | 9/1971 | Lee et al. . | |
| 3,851,681 | 12/1974 | Egan . | |
| 4,314,589 | 2/1982 | Buchanan et al. . | |
| 4,423,755 | 1/1984 | Thompson . | |
| 4,499,927 | 2/1985 | Borel . | |
| 4,592,396 | 6/1986 | Borel et al. | 139/383 A |
| 4,941,514 | 7/1990 | Taipale | 139/383 A |
| 4,985,084 | 1/1991 | Hakkarainen et al. . | |
| 4,987,929 | 1/1991 | Wilson | 139/383 A |
| 4,989,647 | 2/1991 | Marchand | 139/383 A |
| 5,013,330 | 5/1991 | Durkin et al. | 139/383 A X |
| 5,101,866 | 4/1992 | Quigley | 139/383 A |

*Primary Examiner*—Andrew M. Falik

*Attorney, Agent, or Firm*—Lowe, Price, LeBlanc & Becker

[57] ABSTRACT

A two-layer paper machine cloth includes first and second longitudinal yarn systems and at least three transverse yarn systems. To provide effective drainage, at least one transverse yarn system is situated on the paper-forming side of the cloth and at least two transverse yarn systems are situated on the wear side. One of the yarn systems of the wear side consists of yarns having a smaller diameter than the other yarns. The first longitudinal yarn system weaves only with the larger diameter transverse yarns or, alternatively, both with the larger diameter and the smaller diameter yarns and the second longitudinal yarn system weaves only with the smaller diameter longitudinal yarns.

6 Claims, 3 Drawing Sheets

FIG. 1
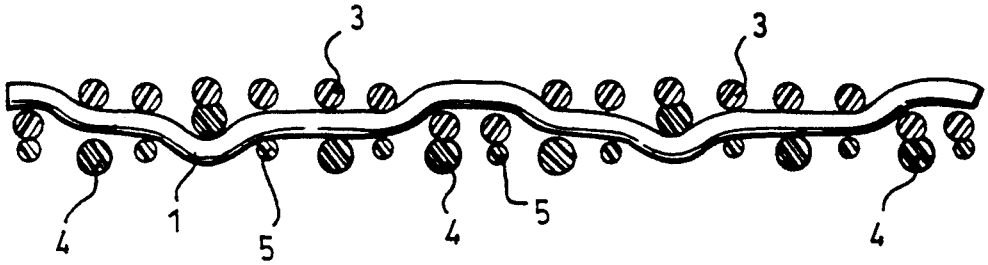
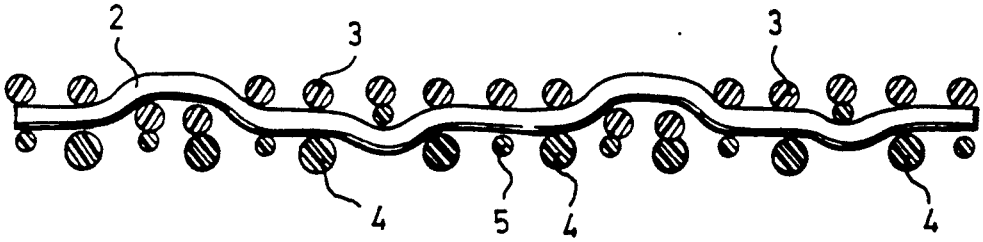
FIG. 2
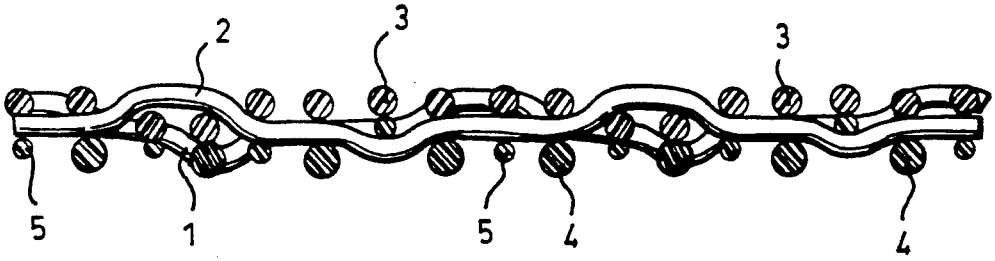
FIG. 3

FIG. 4
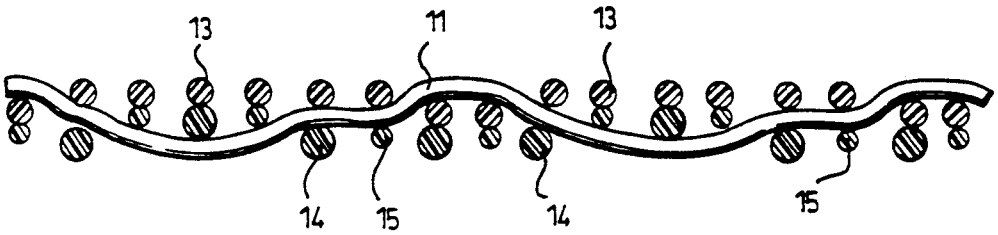
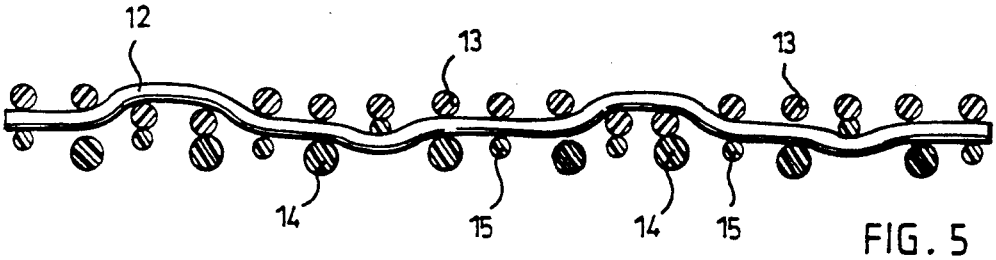
FIG. 5
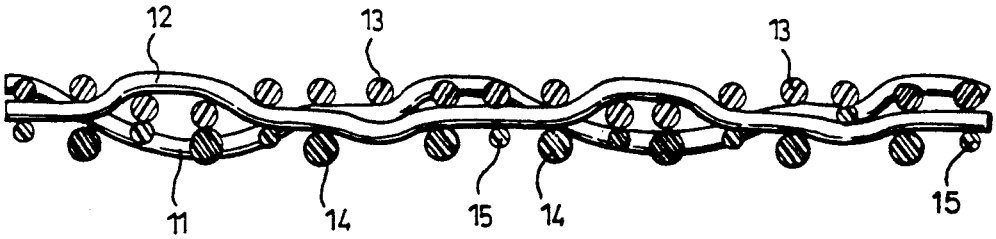
FIG. 6

TWO-LAYER PAPER MACHINE CLOTH

FIELD OF THE INVENTION

The invention relates to a paper machine cloth, comprising longitudinal warp yarns and transverse weft yarns arranged to form a structure of at least two layers.

BACKGROUND OF THE PRIOR ART

Cloths of this type, so-called wires, are well-known in the art. Many wire types are manufactured, one-layer and multi-layer wires, for instance. Amongst multi-layer wires, two-layer wires are perhaps the best known, and these have been used for a long time in the paper making industry.

Double-layer wires have many advantages over single layer fabrics, because the paper side and the wear side of a fabric can be made to have different properties. Normal constructions of double-layer wires have a smooth paper side and a relatively coarse wear side. The disadvantage of two-layer wires is that they have poor dewatering properties when the warp and weft yarns are woven with high density. This causes problems with paper machines leading to high drag loads.

The principal object of the invention is to reduce paper marking and drag loads caused by the wire. This is achieved by means of a paper machine cloth in which the fabric comprises two longitudinal yarn systems and at least three transverse yarn systems, the first transverse yarn system being formed of yarns of a first diameter and being situated on the paper side of the wire, the second transverse yarn system being formed of yarns of a second diameter, and the third transverse yarn system being formed of yarns of a third diameter, which is substantially smaller than the second diameter, the first longitudinal yarn system being interwoven with the yarns of the first and second transverse yarn systems and the second longitudinal yarn system being interwoven with the yarns of the first and third transverse yarn systems, the second longitudinal yarn system being protected from wearing by placing the third transverse yarn system substantially inside the fabric in order to keep the lower knuckles of the second longitudinal yarn system inside the fabric as well.

The advantage of such a paper machine fabric is that it has a higher permeability and lower drag loads than conventional double-layer wires, but it also has a good wear resistance and a non-marking paper side surface and a stable structure.

Wires with conventional construction have longitudinal yarns which weave with every transverse yarn system both on paper side and the wear side. High yarn density in these prior art fabrics usually leads to drainage problems and low yarn density leads to increased sleaziness. Several attempts have been made to improve drainage, wear resistance and marking properties, for example by means of using more than one longitudinal yarn system or by using transverse yarns of alternating diameter on the wear side of the fabric, but so far improvements in some properties have caused deterioration in other properties. The present invention improves both dewatering properties and stability compared to prior art wires.

One application, U.S. Pat. No. 4,499,927, has two separate longitudinal yarn systems, one of which is interwoven with transverse yarn systems of both the paper side and the wear side, and one only with the transverse yarn systems of the paper side. This application aims to protect some of the longitudinal yarns from abrasion wear but at the same time causes increased sleaziness because of a less stable weave construction compared to conventional two-layer wires.

Another prior art construction with longitudinal yarns interwoven with only one side of the fabric is presented in U.S. Pat. No. 4,314,589, where in one embodiment of the invention some of the longitudinal yarns are interwoven with only the lower layer of transverse yarns, and in another embodiment some of the longitudinal yarns are interwoven with only the upper layer of transverse yarns and some longitudinal yarns are interwoven with only the lower layer of transverse yarns. Another characteristic of this invention is a lower number of wear side transverse yarns compared to the number of paper side transversal yarns. This is said to improve drainage, but together with the longitudinal yarns not interwoven with both layers of transversal yarns it also causes sleaziness.

Transversal yarns of alternating diameters have also been used before. An example of this is the invention of U.S. Pat. No. 3,851,681, where alternating diameters have been used to develop an uneven the surface for the wear side in order to increase the life of a single-layer forming fabric. No certain reason for increased life is given, only a surmise that it may be obtained by water flowing along uneven wear-surface and forming a film that lubricates the wear-surface and thus reduces abrasive wear, or that it may be that the provision of larger weft yarns introduces larger wear-surface areas which prolong the life of the fabric. In this application the central idea seems to consist in transversal yarns larger than usual, unlike in the present invention.

Another application of alternating yarn diameters is presented in U.S. Pat. No. 3,603,354. This patent is about a papermakers' felt that has some larger yarns made of incompressible material. The idea of this invention is to keep the shape of the fabric unchanged as the fabric passes through pressure nips and thus to increase void volume compared to fabrics without incompressible yarns. Also in this invention the advantage is achieved by means of the larger yarns of the fabric and not by means of the smaller yarns as in the present invention.

A two-layer wire with an open wear side and a dense paper side is presented in U.S. Pat. No. 4,985,084. In this case the open structure is achieved by leaving every second transversal bottom yarn out and adjusting the weave structure in such a way that every longitudinal yarn weaves with both paper and wear side yarns. This solution makes it possible to provide a papermaking fabric with all necessary properties, such as non-marking surface, good drainage, retention, runability and wear-resistance. The present invention remarkably improves the wear-resistance compared to this wire because the floats of the wear side transverse yarns can be made longer. Also the present invention reduces sleaziness compared to this wire, because the wear side transverse yarns of a smaller diameter stabilize the weave structure.

The prior art wires with an open wear side usually have a sleazy structure either because of missing wear side knuckles of longitudinal yarns or because of extra paper side transversal yarns that require space on the paper side and thus make it necessary to decrease the density of the transverse yarns that form the basic structure of the wire. An example of extra transverse yarns on the paper side is presented in U.S. Pat. No. 4,423,755. These so-called extra wefts do not strengthen the structure of the wire, because they do not interweave with the yarns of the basic structure, but only pass under the floats of the longitudinal yarns between two transverse yarns of the basic structure. These extra wefts lie quite loose on the paper side of the wire and practically no tension is directed to them.

SUMMARY OF THE INVENTION

The wire according to the invention is advantageous mainly in that it has good draining properties despite the high density of warp and weft yarns. A further advantage is that the drag load caused by this kind of wire is smaller than the drag loads caused by prior art wires. Other advantages are a smooth and non-marking paper side surface and good wear resistance properties.

The abovementioned advantages are achieved by using two different diameters of transversal yarns on the bottom side of the wire and by using two systems of longitudinal yarns. Both longitudinal yarn systems weave with both paper side and wear side transversal yarns, with the one difference that the first longitudinal yarn system weaves with the wear side transverse yarns of the larger diameter and the second longitudinal yarn system weaves with the wear side transverse yarns of the smaller diameter. This makes it possible to prevent the wearing of the second system longitudinal yarns, because the transverse yarns of the smaller diameter are located inside the fabric. The second longitudinal yarn system functions as a load bearing system while the first longitudinal system compensates the loss of area to be worn in order to prolong the life of the wire. This arrangement also makes it possible to maintain the best possible tensile strength during the whole life of the wire, because the strength of the second longitudinal yarn system remains unchanged. Also having both longitudinal yarn systems weave with both the paper and the wear side gives the wire an increased stiffness, which improves the runability by preventing a formation of longitudinal creases or ridges that are common with sleazy wires.

Another way to weave the yarns of the first longitudinal yarn system according to the invention is to weave them with transversal wear side yarns of both the larger and the smaller diameter. The first system longitudinal yarns are arranged to weave with a transverse yarn of the smaller diameter at each side of a transverse yarn of the larger diameter. In this application the wear side transverse yarns of the smaller diameter are placed further inside the wire. This arrangement provides more cover for the second group of longitudinal yarns and gives more material to be worn on the wear side because of relatively long wear side floats of the first system longitudinal yarns.

BRIEF DESCRIPTION OF THE DRAWINGS

FIG. 1 shows a cross-sectional view of a first longitudinal yarn system of a first embodiment of the invention.

FIG. 2 shows a cross-sectional view of a second longitudinal yarn system of the first embodiment of the invention.

FIG. 3 shows a cross-sectional view of the first embodiment of the invention.

FIG. 4 shows a cross-sectional view of a first system longitudinal yarn of a second embodiment of the invention.

FIG. 5 shows a cross-sectional view of a second system longitudinal yarn of the second embodiment of the invention.

FIG. 6 shows a cross-sectional view of the second embodiment of the invention.

DETAILED DESCRIPTION OF THE PREFERRED EMBODIMENTS

Figure 7:
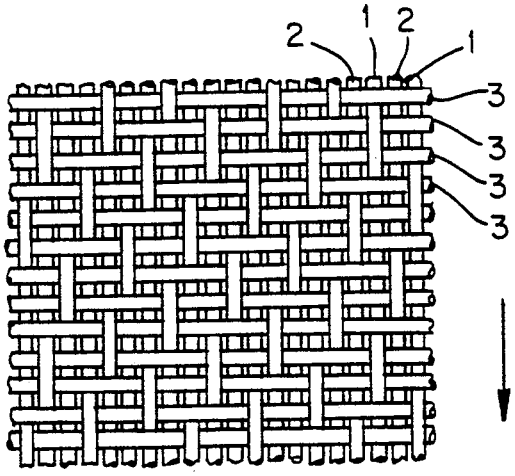
FIG. 7 is a plan view of the paper-forming side of the wire according to both the first embodiment per FIGS. 1–3 and the second embodiment per FIGS. 4–6.
Figure 8:
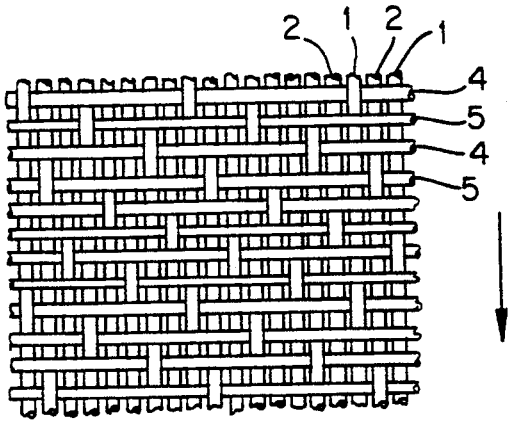
FIGS. 8 and 9 are the respective wear side planar views of the first embodiment per FIGS. 1–3 and the second embodiment per FIGS. 4–6.

FIGS. 1 to 3, 7 and 8 show a first preferred embodiment of the invention. As can be seen from the FIGS. 1 to 3, a paper machine cloth of the invention comprises a first and a second longitudinal yarn system and at least three transverse yarn systems. A yarn of the first longitudinal yarn system is shown in FIG. 1 by reference numeral 1. A yarn of the second longitudinal yarn system is similarly in FIG. 2 by reference numeral 2.

Yarns of the three transverse yarn systems are shown in the figures by reference numerals 3, 4 and 5.

A cross-section of the paper machine cloth of the first embodiment of the invention is shown in FIG. 1 at a yarn 1 of the first longitudinal yarn system and a cross-section of the paper machine cloth of the same embodiment is shown in FIG. 2 at a yarn 2 of the second longitudinal yarn system. A cross-section of the paper machine cloth of the invention is shown in FIG. 3 in such a way that the floats of the two adjacent longitudinal yarns 1 and 2 are visible.

According to the essential idea of the invention, at least one transverse yarn system is situated mainly on the paper forming side of the cloth. Yarns of said transverse yarn system are indicated in the figures by reference numeral 3. In addition, it is essential that at least two transverse yarn systems are situated mainly on the wear side of the cloth against the paper machine. Yarn of these two transverse yarn systems are indicated in the figures by reference numerals 4 and 5.

According to the invention, one of the yarn systems of the wear side of the cloth consists of yarns 5 having a smaller diameter than the yarns 3, 4 of the other transverse yarn systems.

Both longitudinal yarns 1 and 2 weave with transverse yarns both on the paper side and the wear side of the cloth. However, the substantial feature of the paper machine cloth according to FIGS. 1 to 3 is that the yarns 1 of the first longitudinal yarn system weave on the wear side only with the larger diameter transverse yarns 4 of the wear side and the yarns 2 of the second longitudinal yarn system weave on the wear side only with the smaller diameter transverse yarns 5 of the wear side.

It has further been noticed that it is preferable, if the yarns 5 of one transverse yarn system of the wear side have substantially smaller diameters than the other transverse yarns 4 of the wear side. The diameters of the yarns 5 can for instance be about 25% smaller than the diameters of the other yarns of the wear side.

Any suitable material can be used to manufacture the yarns. For example, at least one transverse yarn system of the wear side can consist of yarns made of polyester and one larger diameter transverse yarn system of the wear side consists of yarns made of polyamide.

A second preferred embodiment of the invention is shown in the FIGS. 4 to 6. This embodiment also comprises two longitudinal yarn systems and at least three transverse yarn systems. Yarns of the first longitudinal yarn system are indicated in FIG. 4 by reference numeral 11. Yarns of the second longitudinal yarn system are indicated in FIG. 5 by reference numeral 12.

Yarns of the transverse yarn systems are indicated in the figures by reference numerals 13, 14 and 15.

Figure 9:
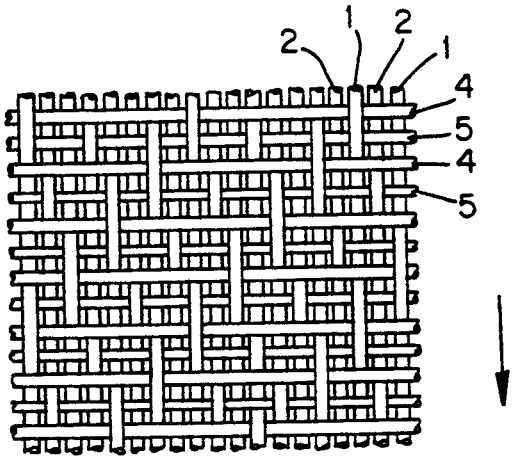

The second preferred embodiment of the invention is shown in FIGS. 4 to 6, 7 and 9 in the same way as the first embodiment in FIGS. 1 to 3.

Also, in this embodiment, at least one transverse yarn system is situated mainly on the paper forming side of the cloth. Yarns of this yarn system are indicated in the figures by reference numeral 13. It is, moreover, essential that at least two transverse yarn systems are situated mainly on the wear side of the cloth against the paper machine. Yarns of these yarn systems are indicated in the figures by reference numerals 14 and 15.

According to this second embodiment of the invention, one of the yarn systems situated against the paper machine consists of the yarns 15 having a smaller diameter than the yarns 14 of the other transverse yarn systems against the paper machine.

The yarns 11 and 12 of both longitudinal yarn systems weave with transverse yarns both on the paper forming side and the wear side of the cloth. However, the essential feature of the second embodiment according to FIGS. 4 to 6 is that the yarns 11 of the first longitudinal yarn system weave on the wear side both with the larger diameter transverse yarns 14 of the wear side and with the smaller diameter transverse yarns 15 of the wear side and the yarns 12 of the second longitudinal yarn system weave on the wear side only with the smaller diameter transverse yarns 15 of the wear side.

It should be noticed also in connection with the second embodiment that the diameters of the yarns 15 of one transverse yarn system of the wear side are substantially smaller than the diameters of the other transversal yarns 14 of the wear side. For example, the diameters of the yarns 15 can be about 25% smaller than the diameters of the yarns 14.

Also in the second embodiment per FIGS. 4 to 6, the manufacturing material of the yarns can be chosen freely according to each particular situation. At least one transverse yarn system of the wear side can consist for instance of yarns made of polyester, and one larger diameter transverse yarn system of the wear side can consist of yarns made of polyamide.

The use of small diameter transversal yarns 5, 15 makes a paper machine cloth possible which has at the same time an open structure of the wear side, a good dewatering property, a non-marking paper forming side, excellent wear resistance properties and a stable weave structure. Such a combination has not been possible on the basis of the prior art technique. The wire of the invention has a thickness of a normal two-layer wire.

The yarns 1, 2 and 11, 12 of the longitudinal yarn systems are situated alternately adjacent to each other in such a way that each yarn adjacent to another yarn always is a yarn of another yarn system, i.e., next to a yarn 1 there is always a yarn 2, etc. By arranging the yarns in this way, the load can be equalized over the entire breadth of the cloth. In connection with the invention it is possible to provide a forming surface as good as in the prior art solutions by adjusting weaving tightnesses of the longitudinal yarn systems in such a way that upper knuckles of the longitudinal yarns are situated at the same level.

The retention of fibres can be improved by increasing the density of the transverse yarns. Such a procedure is not at all always possible in connection with the prior art, i.e, in solutions with a conventional structure of the wear side, because this change worsens the dewatering properties. The open bottom structure according to the present invention makes it possible to increase the transverse yarn density, because the same number of yarns provides a 10 to 15% better permeability compared with a conventional prior art wire. The increased yarn density on the paper side supports the fibres better than before, which leads to an improved retention.

Large drag loads are typical of conventional two-layer wires having a large yarn density on the wear side. When the drag load decreases at the same time as the number of transverse yarns on the wear side gets smaller, it is assumed that the power by which the cloth resists movement depends on the number of yarns hitting against the paper machine dewatering means. According to this theory, it is possible to reduce drag loads without worsening paper making properties by arranging half of the transverse yarns of the wear side substantially within the wire.

The embodiments presented above are by no means intended to restrict the invention, but the invention can be varied within the scope of the claims quite freely. Thus it is clear that the paper machine cloth according to the invention does not need to be absolutely just like shown in the figures, but solutions of another kind are also possible.

I claim:

1. A two-layer paper machine cloth which in use has a paper-forming side and a wear side, comprising:

first and second longitudinal yarn systems: and at least three transverse yarn systems, wherein at least one transverse yarn system is situated mainly on the paper-forming side of the cloth and at least two transverse yarn systems are situated mainly on the wear side of the cloth, one of the yarn systems on the wear side consists of yarns having a relatively smaller diameter than the yarns of the other transverse yarn systems on the wear side, and the first longitudinal yarn system weaves only with the larger diameter transverse yarns of the wear side and the second longitudinal yarn system weaves only with the smaller diameter transverse yarns of the wear side.

2. A paper machine cloth according to claim 1, wherein the diameters of the yarns of one transverse yarn system of the wear side are substantially smaller than the diameters of the other transverse yarns of the wear side.

3. A paper machine cloth according to claim 1, wherein at least one transverse yarn system of the wear side consists of yarn made of polyester and one larger diameter transverse yarn system of the wear side consists of yarns made of polyamide.

4. A two-layer paper machine cloth which in use has a paper-forming side and a wear side, comprising:

two longitudinal yarn systems; and at least three transverse yarn systems, wherein at least one transverse yarn system is situated mainly on the paper-forming side of the cloth and at least two transverse yarn systems are situated mainly on the wear side of the cloth, one of the yarn systems on the wear side consists of yarns having a relatively smaller diameter than the yarns of the other transverse yarn system against the paper machine, and one longitudinal yarn system weaves both with the larger diameter transverse yarns of the wear side and with the smaller diameter transverse yarns of the wear side and the other longitudinal yarn system weaves only with the smaller diameter transverse yarns of the wear side.

5. A paper machine cloth according to claim 4, wherein the diameters of the yarns of one transverse yarn system of the wear side are substantially smaller than the diameters of the other transverse yarns of the wear side.

6. A paper machine cloth according to claim 4, wherein; at least one transverse yarn system of the wear side consists of yarns made of polyester and one larger diameter transverse yarn system of the wear side consists of yarns made of polyamide.

* * * * *